US005125441A

United States Patent [19]

Mette

[11] Patent Number: 5,125,441

[45] Date of Patent: Jun. 30, 1992

[54] APPARATUS FOR FILLING BOTTLES WITH A LIQUID

[75] Inventor: Manfred Mette, Hamburg, Fed. Rep. of Germany

[73] Assignee: alfill Getränketechnik GmbH, Hamburg, Fed. Rep. of Germany

[21] Appl. No.: 687,453

[22] Filed: Apr. 18, 1991

[30] Foreign Application Priority Data

Apr. 23, 1990 [DE] Fed. Rep. of Germany ..... 4012849

[51] Int. Cl.[5] ..... B65B 31/06; B65B 3/26

[52] U.S. Cl. ..... 141/59; 141/39; 141/301; 141/392

[58] Field of Search ..... 141/39, 40, 59, 392, 141/264, 301, 302, 6

[56] References Cited

U.S. PATENT DOCUMENTS 3,500,879 3/1970 Meyer ..... 141/1
3,561,503 2/1971 Rogge ..... 141/59 X
3,799,219 3/1974 Uth et al. ..... 141/39
4,982,768 1/1991 Ahlers ..... 141/6

FOREIGN PATENT DOCUMENTS 7238305 1/1973 Fed. Rep. of Germany .
2428553 2/1975 Fed. Rep. of Germany ..... 141/39
3025786 2/1982 Fed. Rep. of Germany .
1475214 3/1967 France ..... 141/59

*Primary Examiner*—Ernest G. Cusick
*Attorney, Agent, or Firm*—Peter K. Kontler

[57] ABSTRACT

Apparatus for filling large bottles with a beverage has a rotating vessel which contains a supply of pressurized beverage and admits the beverage into a series of metering chambers forming part of container filling modules at the underside of the vessel. The outlet opening of each metering chamber is controlled by a valve which can permit or prevent the flow of beverage into a casing having an inlet for reception of beverage from the metering chamber, an outlet which is radially and vertically offset relative to the inlet, and a helical swirling channel which extends from the inlet to the outlet and surrounds the central vertical axis of the outlet along an arc of approximately or exactly 360°. The cross-sectional area of the channel decreases proportionally with the distance from the inlet, and the intermediate portion of the channel communicates with the outlet by way of a conical passage. The swirling stream of beverage which issues from the outlet continues to circulate in the neck of a bottle so that it provides room for the escape of gas from the bottle in the course of the beverage admitting operation.

20 Claims, 2 Drawing Sheets

APPARATUS FOR FILLING BOTTLES WITH A LIQUID

BACKGROUND OF THE INVENTION

The invention relates to apparatus for filling bottles or other types of containers with a liquid. More particularly, the invention relates to improvements in apparatus which are or can be designed to admit metered quantities of a liquid into successive containers in a container filling plant.

Commonly, owned copending patent application Ser. No. 07/675,428 of Jacek Walusiak for "Apparatus for admitting metered quantities of liquid into bottles or other containers" discloses an apparatus wherein a vessel confines a supply of liquid and carries a plurality of filling devices each of which can admit metered quantities of liquid into successive containers. Each filling device is provided with means for centering and sealingly engaging a container during admission of a metered quantity of liquid. The vessel is or can constitute a ring-shaped tank which rotates about a vertical axis and stores a supply of liquid beneath a cushion of compressed gas. A regulating device is provided to ensure that the liquid level in the vessel remains at least substantially constant; this is desirable to ensure the admission of identical quantities of liquid into each of a short or long series of successive containers, e.g., bottles, jars, cans or the like. The vessel receives fresh liquid from a main source along a path which is surrounded by the vessel. Each filling device (such filling devices are disposed at the underside of the vessel) is provided with gas- and liquid-conveying channels as well as with suitable valves and valve actuating devices.

The apparatus which is disclosed by Walusiak can be used for admission of all kinds of liquids, particularly non-carbonated beverages (such as milk, fruit juices and spring water) and carbonated beverages (such as club soda and many other soft drinks which contain $CO_2$ gas). If the liquid to be admitted into bottles or other types of containers is a carbonated beverage, each filling device is equipped with a pipe which permits gas to escape from the container during admission of liquid, and with many other accessories. Reference may also be had to published German patent application No. 30 25 786.

German Utility Model No. 72 38 305 discloses a container filling apparatus wherein the filling device is provided with a liquid swirling or circulating unit. The purpose of the swirling unit is to set the liquid in rotary motion so that the stream which is admitted into a container beneath the filling device is caused to flow along a circular path at the inner side of the neck of a bottle or another container. The swirling device ensures that the circulating liquid stream is acted upon by centrifugal force and flows along the internal surface of the container so that the liquid does not interfere with the outflow of air or another gas which is being expelled as a result of admission of liquid. As a rule, the gas is caused to leave the container by way of a pipe which extends into the open top of the container from above. The swirling unit reduces the likelihood of penetration of admitted liquid into the pipe.

The swirling unit which is disclosed in the German Utility Model employs a valve with a liquid-receiving chamber and a valving element which is movable to permit or prevent the flow of liquid from the chamber. Liquid which is to leave the chamber must flow along edges which impart to the liquid a swirling or circulating motion. Such design is not conducive to the establishment of a satisfactory swirling or circulating liquid stream. Moreover, the apparatus of the German Utility Model cannot be used for admission of accurately metered quantities of a liquid into each of a series of containers. Still further, the level of the lower end of the aforementioned gas evacuating pipe determines the upper level of the body of liquid in a container. In addition, a freshly filled container must be lowered through a considerable distance in order to move the open upper end of the container beneath the gas evacuating pipe; this affects the output of the apparatus and contributes to complexity of the conveyor means for empty and filled containers.

OBJECTS OF THE INVENTION

An object of the invention is to provide an apparatus which can be used with particular advantage for admission of metered quantities of beverages or other liquids into large bottles or other types of containers and wherein the liquid stream that enters a container is caused to circulate in a novel and improved way.

Another object of the invention is to provide a novel and improved liquid conveying unit which can be used in container filling apparatus as a superior substitute for heretofore known liquid conveying units.

A further object of the invention is to provide the liquid conveying unit with a swirling arrangement which is constructed and assembled in such a way that each container can be filled all the way to the top.

An additional object of the invention is to provide the apparatus with a swirling or circulating arrangement which permits the admission of accurately metered quantities of a liquid into each of a series of containers and which can be used in conjunction with certain presently known liquid conveying units.

Still another object of the invention is to provide a simple, compact and inexpensive swirling arrangement which does not appreciably reduce the rate of admission of liquid into successive containers.

SUMMARY OF THE INVENTION

The invention is embodied in an apparatus for filling successive containers (such as large bottles) of a series of containers with a liquid (e.g., a carbonated or non-carbonated beverage). The improved apparatus comprises a source of liquid (e.g., an annular tank which is rotatable about a vertical axis), container filling means having at least one liquid discharging opening and defining a path for the flow of liquid from the source to the at least one opening, and a liquid conveying unit having an inlet in communication with the at least one opening, an outlet for admission of liquid into successive containers, and a liquid swirling or circulating channel which conveys liquid from the inlet toward the outlet and extends around the outlet along an arc which is at least close to 360°. The cross-sectional area of the swirling channel decreases in the direction of liquid flow from the inlet. The arrangement is preferably such that the outlet has a substantially vertical axis and the swirling channel surrounds the axis. The channel has a liquid-receiving end in communication with the inlet and a second end which is remote from the first end. The cross-sectional area of the channel at the second end is at least close to zero, and such cross-sectional area decreases from the first end toward the second end at a rate which is proportional to the distance from the first end.

The outlet is preferably offset with reference to the inlet in the direction of the axis of the outlet and also radially of the axis.

In accordance with a presently preferred embodiment, the swirling channel defines a helical path for the flow of liquid from the inlet toward the outlet.

The liquid-receiving first end of the channel is preferably located at a predetermined radial distance from the axis of the outlet, and such distance at least equals or exceeds the distance of the inlet from the axis of the outlet (as measured radially of the axis).

The channel includes an intermediate portion between the first and second ends, and such intermediate portion discharges liquid into the outlet at a rate which is substantially proportional with the distance from the first end. The cross-sectional area of the channel decreases at a rate which is proportional to the increasing rate of liquid flow from the intermediate portion.

If the width of the swirling channel is at least substantially constant, the height of the channel (as measured in the direction of the axis of the outlet) decreases from the first toward the second end at the aforementioned rate, namely so that the channel is continuously filled with liquid even though liquid is free to flow from the intermediate portion of the channel.

The liquid conveying unit further comprises a substantially funnel-shaped passage which connects the intermediate portion of the channel with the outlet. The channel is configurated to circulate the liquid which flows from the inlet about the axis of the outlet, and the liquid continues to circulate in the passage, in the outlet as well as upon entry into a container by way of the outlet. The passage preferably comprises a conical inlet portion which communicates with the intermediate portion of the channel, and a substantially or nearly annular lower portion which surrounds the axis of the outlet and communicates with the outlet. The liquid conveying unit has a substantially cylindrical internal surface which surrounds the swirling channel and has an axis which coincides with the axis of the outlet. The passage has a radially outermost portion at the cylindrical surface.

The liquid conveying unit can be provided with at least one obstruction which is located in the aforementioned passage and serves to slow down or to terminate the circulation of liquid in the passage upon each interruption of admission of liquid into the swirling channel by way of the inlet. The obstruction can include at least one surface which directs the liquid toward the axis of the outlet, and such surface can extend substantially or exactly radially of the axis of the outlet. Thus, the obstruction or obstructions can be provided in that surface (or can form part of that surface) of the liquid conveying unit which is adjacent the passage.

The filling means can comprise a valve with a valving element movable between a first position in which the opening is free to receive liquid from the source and a second position in which the valving element seals the opening and the inlet from the source.

The filling means can comprise a liquid metering chamber which receives liquid from the source and defines a portion of the aforementioned path. The metering chamber has an outlet which communicates with or constitutes the at least one opening. The aforementioned valve can serve to seal the opening and the inlet upon evacuation of a metered quantity of liquid from the chamber into the inlet and thence into the swirling channel. An inlet of the chamber can receive liquid from the source when the opening is sealed and vice versa.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
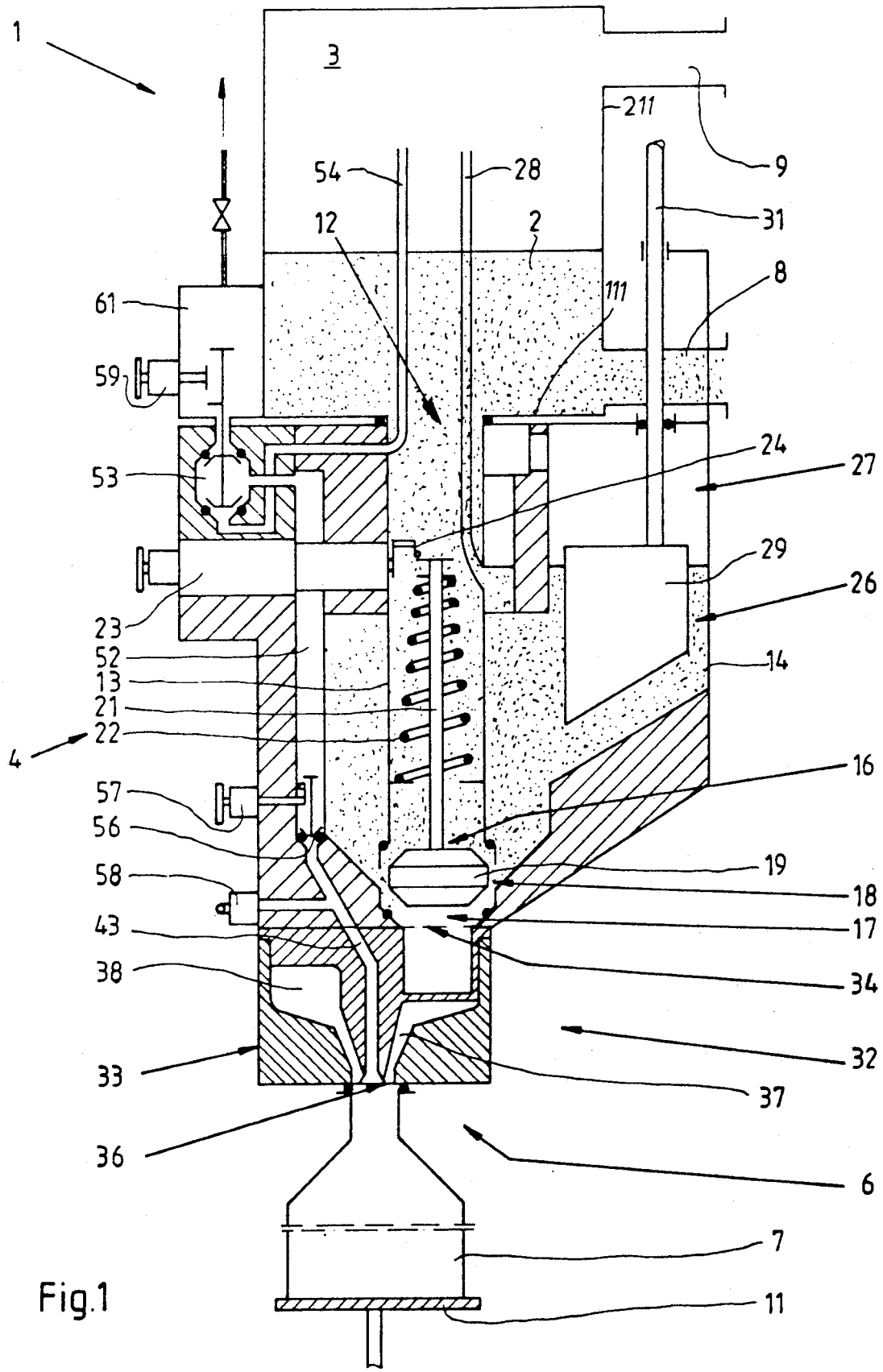
FIG. 1 is a fragmentary vertical sectional view of an apparatus which embodies one form of the invention, a container being shown in the process of receiving a metered quantity of liquid by way of a swirling channel.

FIG. 1 shows a portion of an apparatus which is used to admit metered quantities of a liquid 2 (e.g., a carbonated beverage) into relatively large containers 7. The illustrated container 7 is a relatively large bottle which is delivered to the liquid receiving position by a mobile platform 11. Reference may be had to commonly owned copending patent application Ser. No. 07/568,254 of Manfred Mette for "Method of and apparatus for filling containers with liquids" and to commonly owned copending patent application Ser. No. 07/568,257 of Wolfgang Fiwek et al. for "Method of and apparatus for filling and capping containers for beverages and the like" which describe and show suitable conveyor systems for delivery of empty containers to, and for removal of filled containers from, filling stations at a level below a rotary ring-shaped vessel for a supply of liquid.

The apparatus which is shown in FIG. 1 comprises a source of liquid in the form of a ring-shaped vessel 1 which contains a supply or body of liquid 2 beneath a cushion 3 of a compressed gaseous fluid (e.g., $CO_2$ gas). The bottom wall 111 of the vessel 1 carries an annulus of equidistant container filling modules 4 each of which comprises or is connected to a combined container centering and sealing device 6. In accordance with a feature of the invention, each combined centering and sealing device 6 comprises a novel liquid conveying unit 32 which serves to impart to the liquid a swirling or circulating motion prior to, during and subsequent to admission into the open top of a container 7 on the mobile platform 11 which happens to be in register with the illustrated device 6. FIG. 1 merely shows a single module 4 because all other modules are constructed and operate in the same way.

The vessel 1 receives liquid 2 by way of one or more supply conduits 8, and the supply of gas in the cushion 3 can be replenished by way of one or more supply conduits 9. These conduits deliver liquid and gas from central or main sources which are not shown in the drawing. Each of the conduits 8, 9 discharges into the respective portion of the vessel at the inner wall 211.

The apparatus is further provided with means for maintaining the upper surface of the body of liquid 2 in the vessel 1 at or close to a preselected level because this promotes predictable admission of accurately metered quantities of liquid into each of a short or long series of containers 7. For the same reason, the apparatus further comprises means for ensuring that the pressure of gas in the cushion 3 remains at least substantially constant; this ensures that the circumstances for admission of liquid into successive containers 7 are at least nearly identical. The vessel 1 is caused to rotate about a vertical axis which is located to the right of FIG. 1, and the platforms 11 of the conveyor for containers 7 are moved along endless paths so that each liquid conveying unit 32 moves to a position of register with an empty container 7 at a first station adjacent the path of movement of the modules 4 and thereupon continues to register with such container during movement along a predetermined portion of the endless path for the modules 4 about the axis of rotation of the vessel 1. Reference may be had again to the aforementioned copending patent application Ser. No. 07/568,257 of Wolfgang Fiwek et al. as well as to commonly owned copending patent application Ser. No. 07/568,273 of Manfred Mette for "Apparatus for filling bottles and the like."

The bottom wall 111 of the vessel 1 has equidistant openings 12 which admit liquid into downwardly extending tubular fluid conveying extensions 13, one for each module 4. Each extension 13 can constitute an elongated cylinder the upper end of which carries a flange which is welded or otherwise sealingly secured to the bottom wall 111 around the respective opening 12. The illustrated extension 13 projects downwardly into a metering chamber 14 of the module 4 and its lower end defines an outlet 16 which delivers liquid 2 from the vessel 1 into the metering chamber in the lower end position of the vertically movable valving element 19 of a twin-seat valve 18 of the type described and shown in the aforementioned copending patent application Ser. No. 07/675,428, of Jacek Walusiak for "Apparatus for admitting metered quantities of liquid into bottles or other containers". The metering chamber 14 and the extension 13 can be assembled prior to attachment of the upper end of the extension to the bottom wall 111 of the vessel 1. This ensures that the vessel 1 need not be altered for the express purpose of carrying an annulus of modules 4.

The lower end of the metering chamber 14 is provided with an opening 17 which serves to discharge a metered quantity of liquid 2 into the container 7 on the platform 11 beneath the respective liquid conveying unit 32. The valving element 19 of the valve 18 is designed to seal the opening 17 when it is caused to assume the lower end position, i.e., when the outlet 16 of the extension 13 is exposed so that liquid 2 is free to flow from the vessel 1 into the chamber 14. When the valving element 19 is caused to move to the upper end position, the outlet 16 of the extension 13 is sealed but the opening 17 (i.e., the outlet of the metering chamber 14) is free to admit a metered quantity of liquid 2 from the chamber 14 into the container 7 on the adjacent platform 11, and such liquid is caused to flow through the liquid conveying unit 32 of the combined centering and sealing device 6.

The valving element 19 is affixed to the lower end of an upright rod-shaped moving member 21. An energy storing element 22 in the form of a coil spring is installed in the extension 13 around the moving member 21 and reacts against an internal collar of the extension 13 to bias the valving element 19 upwardly, i.e., to that end position in which the outlet 16 of the extension 13 is sealed. When the pressure at the opening 17 of the metering chamber 14 drops to atmospheric pressure (i.e., when a filled container 7 has been moved away from the underside of the liquid conveying unit 32 or when the interior of the container 7 beneath the unit 32 is still under atmospheric pressure), pressurized liquid 2 in the extension 13 bears upon the upper side of the valving element 19 and moves it to the lower end position in which the outlet 16 is free to admit liquid into the metering chamber 14 while the outlet opening 17 of the metering chamber is sealed from an inlet 34 of the liquid conveying unit 32. The pressure in an empty container 7 beneath the unit 32 is caused to rise while the extension 13 admits liquid into the metering chamber 14 so that the pressure of gas at the underside of the valving element 19 matches the pressure of liquid in the extension 13. At such time, the spring 22 is free to lift the valving element 19 via moving member 21 so that the outlet 16 is sealed and the opening 17 is exposed to admit a metered quantity of liquid into the container 7 on the platform 11 beneath the unit 32.

The valving element 19 can be moved to the lower end position (in which the opening 17 is sealed) against the opposition of the spring 22 when the transfer of a metered quantity of liquid 2 from the chamber 14 into the container 7 is completed. To this end, the module 4 is equipped with a shifting mechanism 23 having an eccentric 24 which can depress the moving member 21 and the valving element 19 in response to engagement of the exposed portion of the mechanism 23 by a stationary cam (not shown) adjacent the path of movement of the module 4 about the vertical axis of rotation of the vessel 1. The shifting mechanism 23 can constitute a mechanical flip-flop of the type described in the aforementioned copending patent application Ser. No. 07/675,428 of Jacek Walusiak for "Apparatus for admitting metered quantities of liquid into bottles or other containers". An advantage of a flip-flop is that the length of the interval which elapses to move the valving element 19 from the upper end position to the lower end position (i.e., to seal the opening 17 upon completion of a container-filling operation) is not dependent upon the speed of rotary movement of the vessel 1.

The chamber 14 comprises a liquid metering compartment 26 which can receive a predetermined quantity of liquid 2, and a gas-receiving compartment 27 above the compartment 26. A gas conveying conduit 28 is provided to connect the chamber 14 with the space for the gas cushion 3 above the body of liquid 2 in the vessel 1. The lower end of the conduit 28 is located at a level beneath the compartment 27 which latter is sealed from the atmosphere and stores a supply of gas acting as a buffer above the supply of liquid in the lower compartment 26 of the chamber 14.

The capacity of the compartment 26 can be varied by a displacing element 29 in the form of a plunger at the lower end of an elongated vertical adjusting rod 31. The rod 31 is accessible from without the vessel 1 so that the latter need not be altered for the purpose of installing the rod 31 and/or the displacing element 29.

The opening 17 of the metering chamber 14 admits liquid 2 into the inlet 34 of the liquid conveying unit 32. The latter comprises a housing or casing 33 which defines the inlet 34, an outlet 36 which is radially and axially offset relative to the inlet 34, and a preferably helical swirling channel 38 which receives liquid from the inlet 34 and extends around the vertical axis 44 (FIG. 2) of the outlet 36. The casing 33 further defines a conical passage 37 which communicates with an elongated intermediate portion of the swirling channel 38 and has an annular or substantially annular lower portion which is concentric with and communicates with the outlet 36. The swirling channel 38 serves to convey liquid from the inlet 34 to the outlet 36 by way of the passage 37.

The casing 33 includes a lower section 39 which is provided with the outlet 36 and an upper section 42 which defines the inlet 34. The lower section 39 has a conical internal surface 41 which surrounds the passage 37 and includes a conical upper portion 41*a* beneath the channel 38. The upper section 42 of the casing 33 comprises a conduit 43 defining a path for the flow of gas into or from a container 7 beneath the lower section 39. The open upper end of the container 7 can sealingly engage the underside of the section 39 or one or more sealing elements (not shown) which are provided at such location to prevent the escape of compressed gas and/or liquid in the course of a container filling operation. The path which is defined by the conduit 43 is surrounded by the annular outlet 36 in the lower section 39 of the casing 33. The swirling channel 38 is bounded by an internal surface of the upper section 42, by a cylindrical internal surface 141 of the lower section 39, by the external surface of the conduit 43 and by the internal surface 41 (if the passage 37 is considered an integral part of the channel 38).

Figure 2:
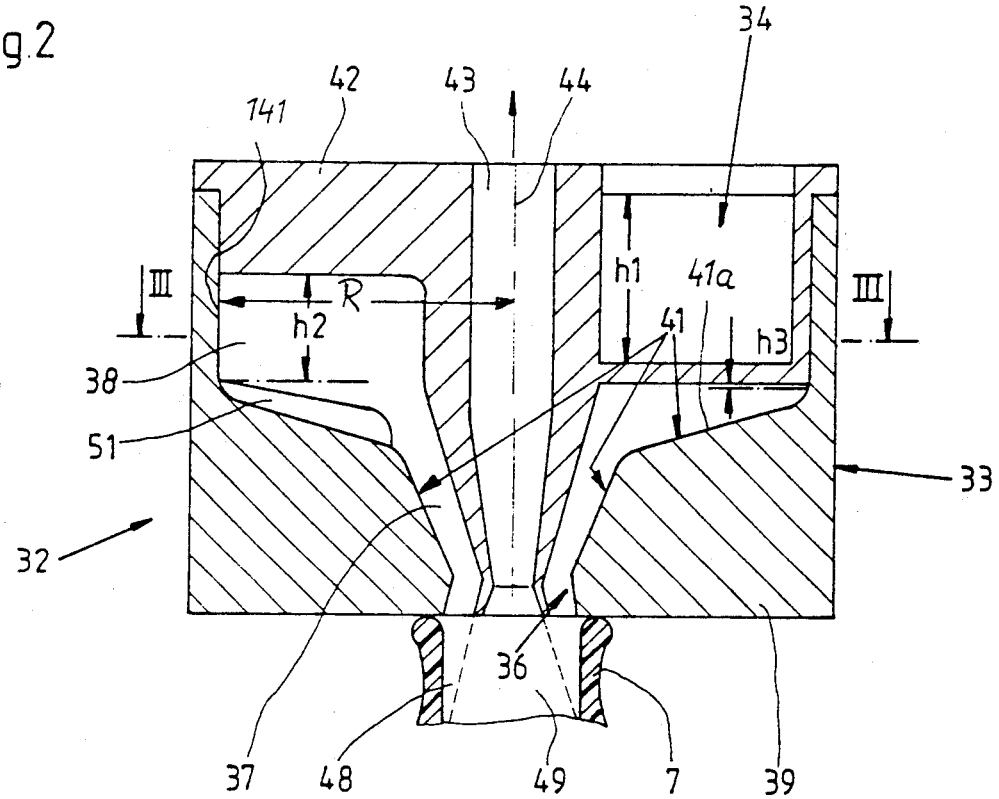
FIG. 2 is an enlarged sectional view of a detail in the apparatus of FIG. 1, the section being taken in the direction of arrows as seen from the line II—II in FIG. 3.
Figure 3:
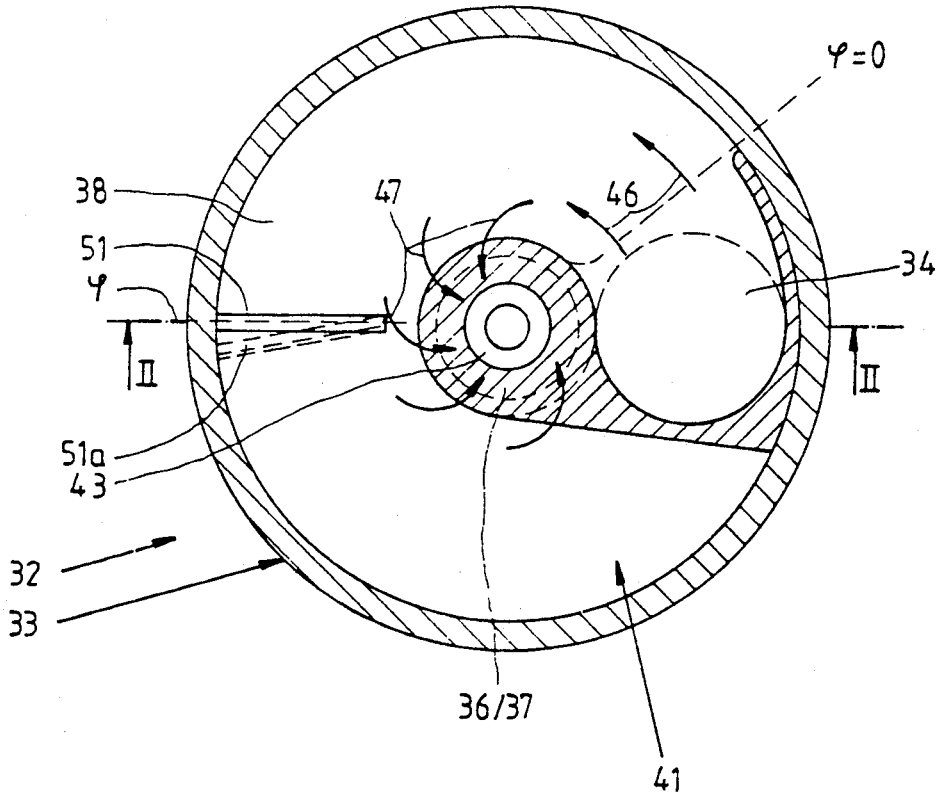
FIG. 3 is a horizontal sectional view as seen in the direction of arrows from the line III—III of FIG. 2.

FIG. 3 shows that the illustrated swirling channel 38 forms a helix which has a first end at the inlet 34 and extends around the axis 44 of the outlet 36. As already mentioned above, the outlet 36 is offset relative to the inlet 34 in the direction of the axis 44 as well as radially of such axis. However, the inlet 34 does not extend radially of the axis 44 beyond that portion of the channel 38 (note the radius R of the cylindrical internal surface 141 in FIG. 2) which is located at a maximum radial distance from the axis 44. Such design contributes to compactness of the unit 32 and establishes highly satisfactory circumstances for desirable swirling of the liquid on its way from the opening 17 toward and beyond the outlet 36 when the valving element 19 is held in the upper end position to seal the outlet 16 of the extension 13 but to permit the metering chamber 14 to discharge liquid by way of the opening 17.

The swirling channel 38 extends around the axis 44 along an arc $\phi$ of close to or exactly 360°. The bottom of this channel is bounded by the conical portion 41*a* of the surface 41. Nearly the entire underside of the intermediate portion of the channel 38 between its first and second ends is open toward the conical passage 37. The height (and hence the volume) of the channel 38 decreases in a direction from the first end (i.e., from the inlet 34) toward the second end proportionally with the rate of flow of liquid into the conical passage 37 and proportionally with the increasing magnitude of the arc $\phi$. The maximum height $h_1$ of the channel 38 can equal or approximate the depth of the inlet 34, the character $h_2$ denotes an intermediate height of the channel 38, and the character $h_3$ denotes a minimum height (which can be zero or close to zero) at the second end of the channel 38. The direction of liquid flow in the channel 38 is indicated by the arrows 46 (FIG. 3). At the same time, a portion of liquid which leaves the outlet 34 flows from the channel 38 into the passage 37; this is indicated in FIG. 3 by arrows 47. The direction of flow of liquid which flows into the passage 37 (arrows 47) has a pronounced component in the circumferential direction (i.e., around the axis 44), and such tendency remains while the liquid flows in the passage 37 as well as in the outlet 36 and thereafter in the upper end portion of the container 7 beneath the outlet 36. The height of the channel 38 decreases proportionally with the quantity of liquid which circulates in the channel as a result of the flow of liquid into the passage 37 (arrows 47). This ensures that the channel 38 remains filled with liquid all the way to its second end (having the height $h_3$ or less). Such mode of operation of the unit 32 is desirable and advantageous because the liquid stream which flows in the channel 38 along a helical path around the axis 44 of the outlet 34 is not likely to develop turbulence and/or to carry entrapped bubbles of gaseous fluid. Moreover, the column of liquid in the metering chamber 14 can exert a constant and predictable pressure upon the stream of liquid which continuously fills and circulates in the channel 38. In addition, such mode of conveying liquid in the channel 38 ensures that the passage 37 contains a stream which closely hugs the surface 41 and exhibits a pronounced swirl, i.e., it circulates about the axis 44 in a manner such that the swirling movement does not cease during flow through the outlet 36 but continues in the interior of the container 7. The swirling flow in the upper portion of the container 7 beneath the casing 33 of FIG. 2 is indicated by broken lines, as at 48. This establishes in the container 7 a liquid-free space 49 through which the gas can flow from the interior of the container into the conduit 43 without interference on the part of the swirling flow 48. The gas stream which leaves the container 7 by way of the conduit 43 is or can be admitted into the vessel 1.

In order to accelerate the evacuation of liquid from the swirling channel 38 into the container 7 when the valving element 19 has been caused to seal the opening 17, i.e., when the admission of liquid into the inlet 34 is terminated, the unit 32 is preferably provided with one or more obstructions 51 and 51*a* which can constitute portions of the surface 41 adjacent the conical passage 37 and promote the flow of liquid radially inwardly toward the axis 44. For example, at least one obstruction can be constituted by a rib or an analogous projection of the surface 41, and such projection can but need not extend exactly radially of the axis 44. It is also possible to employ one or more vanes, grooves or other forms of depressions or recesses or combinations of such obstructions. All that counts is to ensure that, when the channel 38 is no longer filled with liquid (because the valving element 19 seals the opening 17 of the metering chamber 14), the remaining liquid can rapidly enter the passage 37 and leave the unit 32 through the outlet 36 and to enter the container 7 beneath the casing 33. Thus, each such obstruction can interrupt or at least impede further circulation of liquid in the channel 38 during a certain (final) stage of a container filling operation to accelerate such stage by ensuring that the remnant of liquid is not permitted to circulate in the channel 38 but is immediately deflected or diverted into the passage 37 and thence into the outlet 36. The dimensions of the obstruction or obstructions 51, 51*a* are selected in such a way that their resistance to circulation of liquid in the channel 38 in the course of the major part of a container filling operation (when the opening 17 is exposed and can admit liquid into the inlet 34) is negligible or minimal. The obstruction 51*a* (shown by broken lines) is a strip, groove or vane which does not extend exactly radially of the axis 44.

Referring again to FIG. 1, the upper end of the conduit 43 communicates with a conduit 52 which is provided in the housing of the module 4 and contains a pressure varying valve 53. A pipe 54 extends from the valve 53 into the upper portion of the vessel 1 by way of the respective opening 12. A shutoff valve 56 in the conduit 52 can be actuated by a cam-operated mechanism 57 to seal the conduit 43 from the cushion 3 in the vessel 1 in order to prevent escape of compressed gas from the vessel when the underside of the lower section 39 of the casing 33 is not engaged by the open top of a container 7. A relief valve 58 is provided to connect the conduit 43 with the atmosphere (while the valve 56 is closed) to permit a reduction of pressure in a freshly filled container 7 before the latter is caused to leave the position of FIG. 1.

The valve 53 is actuatable by a cam-operated mechanism 59 to selectively connect the conduit 52 with the pipe 54 (i.e. with the upper portion of the vessel 1) or with a plenum chamber 61 wherein the pressure is lower than the pressure above the body of liquid 2 in the vessel 1. The container filling operation is accelerated to a great extent if the valve 53 is set to connect the conduit 52 (and hence the interior of the container 7 below the unit 32) with the plenum chamber 61 once the container filling operation is in progress. This is of particular importance when the containers 7 are large bottles.

In order to start a container filling operation, the platform 11 delivers a container 7 (e.g., a large bottle which is made of polyethylene or another suitable plastic material) to the position of FIG. 1 or 2 so that the lower section 39 of the casing 33 of the liquid conveying unit 32 seals the open top of the container from the atmosphere. The valve 56 is opened by the mechanism 57 which is engaged by a stationary cam adjacent the path of movement of the module 4 about the axis of rotation of the vessel 1. This ensures that the pressure in the interior of the empty container 7 rises to match the pressure of the cushion 3 in the vessel 1 because the valve 53 is set to connect the conduit 52 with the pipe 54. The spring 22 lifts the valving element 19 to seal the outlet 16 and to simultaneously expose the opening 17 as soon as the pressure in the container 7 matches or approximates the pressure of the cushion 3, i.e., the pressure of liquid in the extension 13. A metered quantity of liquid 2 is then free to leave the lower compartment 26 of the chamber 14 and to flow through the casing 33 into the container 7. This results in the formation of a circulating stream 48 in the neck of the container 7 and leaves the aforementioned space 49 for the escape of gas from the container 7 into the conduits 43 and 52. A stationary cam which is adjacent the path of movement of the module 4 actuates the mechanism 59 to change the position of the valving element in the valve 53 so that the conduits 43 and 52 are connected with the plenum chamber 61 instead of with the upper portion of the vessel 1. This enables the liquid which flows from the lower compartment 26 of the metering chamber 14 to more rapidly fill the container 7 beneath the casing 33. The mechanism 57 is caused to close the valve 56, the mechanism 59 is caused to reset the valve 53 (so that the conduit 52 is connected with the pipe 54) and the relief valve 58 is opened when the filling operation is completed so that the pressure in the filled container 7 drops to atmospheric pressure and the gas which forms the cushion 3 is prevented from escaping via conduit 43 when the filled container is thereupon advanced away from the casing 33, normally to a suitable capping station such as is disclosed, for example, in the aforementioned copending patent application Ser. No. 07/568,257 of Wolfgang Fiwek et al.

The obstruction or obstructions 51, 51*a* ensure that the contents of the swirling channel 38 are evacuated practically immediately following movement of the valving element 19 to the lower end position in which the opening 17 is sealed so that the admission of liquid into the inlet 34 is terminated. Since the conduit 43 need not extend downwardly beyond the underside of the lower section 39 of the casing 33, the platform 11 is required to descend through a small or negligible distance (merely to terminate sealing engagement between the open top of the freshly filled container 7 and the unit 32) before the conveyor including the platform 11 can remove the filled container and deliver an empty container to an optimum position beneath the casing 33.

An important advantage of the improved apparatus, and particularly of the liquid conveying unit 32, is that the aforedescribed configuration of the swirling channel 38 ensures the formation of a circulating liquid stream 48 which is devoid of turbulence and is also devoid of entrapped gas bubbles. This is attributable to the fact that the channel 38 is always filled with liquid when the valving element 19 permits the liquid to flow from the metering chamber 14 into the inlet 34 and thence into the swirling channel 38. Moreover, and since the channel 38 is normally filled with liquid, the pressure of liquid is predictable in the entire channel to thus ensure that the unit 32 invariably produces an optimum (particularly stable) swirling or circulating action which remains intact in the passage 37, in the outlet 36 as well as in the upper portion of the container 7. The stream 48 is compelled to flow along the internal surface of the container 7 under the action of centrifugal force and does not interfere with upward flow of the gas which must be expelled from the container in the course of the filling operation.

The aforedescribed configuration of the channel 38 and of the passage 37, as well as the positions of the inlet 34 and outlet 36 relative to each other, contribute to reliability of the filling operation and ensure that the inflowing liquid does not interfere with the outflow of gas and/or vice versa. The helical channel 38, in conjunction with the inlet 34 and outlet 36 (which latter is radially and axially offset relative to the inlet), ensures the establishment of a rotationally symmetrical liquid stream 48 which is desirable for optimum circulation of liquid in the unit 32 and in the container 7 below such unit.

The passage 37 is designed to receive the liquid from the channel 38 while permitting the thus received liquid to continue the circulating movement about the axis 44. The flow of liquid from the passage 37 into the outlet 36 takes place without appreciable changes in the circulation of liquid about the axis 44. The surfaces bounding the passage 37 can be readily formed and finished prior to insertion of upper section 42 into the lower section 39 of the casing 33.

An advantage of the feature that the casing 33 need not contain any valves is that the flow of liquid in the inlet 34, in the channel 38, in the passage 37 and in the outlet 36 is predictable because it is not influenced by intermittent changes of the cross-sectional area of the path for the flow of liquid from the opening 17 to the outlet 36 and thence into a container 7 beneath the casing 33.

Though the improved apparatus can embody modules 4 which depart form the illustrated module 4 and need not be provided with means for accurately metering the quantities of liquid which is admitted into successive containers, the unit 32 can be used with particular advantage in apparatus which embody liquid metering means and wherein a liquid must be admitted into containers which are filled with a compressed gaseous fluid.

An additional important advantage of the improved apparatus is that the conduit 43 need not extend into the container 7 below the casing 33. This is desirable and advantageous because it contributes to the output of the apparatus, i.e., it takes very little time to replace a freshly filled container 7 below the casing 33 with an empty container because the platforms 11 for empty and filled containers must perform very short upward and downward strokes.

The liquid conveying unit 32 is simple, compact and inexpensive, particularly since it need not be equipped with one or more valves and need not have any other moving parts. This further ensures that the path for the liquid in the casing 33 is not readily clogged because the admitted liquid can flow at a predictable rate all the way from the inlet 34 (i.e., from the opening 17) into and beyond the outlet 36. Therefore, if the liquid happens to contain solid particles, such particles are highly unlikely to gather in the casing 33. The gas which escapes from a container 7 into and upwardly through the conduit 43 is unlikely to entrain any liquid particles because the stream 48 closely hugs the internal surface at the open top of the container 7 and the conduit 43 does not and need not extend into the container.

The improved apparatus can be used with particular advantage for admission of metered quantities of carbonated or other beverages into relatively large bottles. The filling of such large bottles, especially while the interior of the bottle is maintained above atmospheric pressure, takes up a relatively long interval of time, and such interval can be reduced because the liquid which leaves the chamber 14 via opening 17 encounters little resistance to the flow through the casing 33 even though it is caused to circulate about the axis 44 of the conduit 43, and also because the valve 53 can be reset shortly or immediately after the start of a container filling operation to ensure that the gas which is confined in the container encounters a relatively low resistance to flow out of the container and into the plenum chamber 61 rather than into the upper portion of the vessel 1 wherein the pressure is higher than in the chamber 61.

The unit 32 can be prefabricated and used in conjunction with available types of modules 4, such as that described in the aforementioned copending patent application Ser. No. 07/675,428 of Jacek Walusiak. This contributes to lower cost of the container filling apparatus.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for filling successive containers of a series of containers with a liquid, comprising a source of liquid; container filling means having at least one liquid discharging opening and defining a path for the flow of liquid from said source to said at least one opening; and a liquid conveying unit having an inlet in communication with said at least one opening, an outlet for admission of liquid into successive containers, and a liquid swirling channel which conveys liquid from said inlet toward said outlet and extends around said outlet, said outlet having a substantially vertical axis and said channel surrounding said axis, said outlet being offset with reference to said inlet in the direction of said axis, said channel having a liquid-receiving first end in communication with said inlet and a second end remote from said first end, the cross-sectional area of said channel decreasing in the direction of liquid flow from said first end toward said second end at a rate which is proportional to the distance from said first end.

2. The apparatus of claim 1, wherein said outlet is offset with reference to said inlet radially of said axis.

3. The apparatus of claim 1, wherein said channel defines a helical path for the flow of liquid from said inlet toward said outlet.

4. The apparatus of claim 1, wherein said channel includes an intermediate portion between said first and second ends which discharges liquid into said outlet at an increasing rate substantially proportional with the distance of said intermediate portion from said first end, the cross-sectional area of said channel decreasing at a rate which is proportional to the increasing rate of liquid flow from said intermediate portion of said channel into said outlet.

5. The apparatus of claim 1, wherein the height of said channel in the direction of said axis decreases from said first end toward said second end.

6. The apparatus of claim 1, wherein said filling means includes a liquid metering chamber which receives liquid from said source and defines a portion of said path, said metering chamber having an outlet which constitutes said at least one opening and said filling means further comprising a valve which is operable to seal said at least one opening and said inlet upon evacuation of a metered quantity of liquid from said chamber into said inlet and said channel.

7. The apparatus of claim 6, wherein said chamber has an inlet which receives liquid from said source when said opening is sealed.

8. The apparatus of claim 1, wherein said swirling channel extends around said outlet along an arc of at least close to 360°.

9. Apparatus for filling successive containers of a series of containers with a liquid, comprising a source of liquid; container filling means having at least one liquid discharging opening and defining a path for the flow of liquid from said source to said at least one opening; and a liquid conveying unit having an inlet in communication with said at least one opening, an outlet for admission of liquid into successive containers, and a liquid swirling channel which conveys liquid from said inlet toward said outlet and extends around said outlet, said outlet having a substantially vertical axis and said channel surrounding said axis, said channel having a liquid-receiving first end in communication with said inlet and and a second end remote rom said first end, said first end being disposed at a predetermined radial distance from said axis and said inlet being spaced apart from said axis a distance which at most equals said predetermined distance, the cross-sectional area of said channel decreasing in the direction of liquid flow from said first end toward said second end at a rate which is proportional to the distance from said first end.

10. Apparatus for filling successive containers of a series of containers with a liquid, comprising a source of liquid; container filling means having at least one liquid discharging opening and defining a path for the flow of liquid from said source to said at least one opening; and a liquid conveying unit having an inlet in communication with said at least one opening, an outlet for admission of liquid into successive containers, and a liquid swirling channel which conveys liquid from said inlet toward said outlet and extends around said outlet, said outlet having a substantially vertical axis and said channel surrounding said axis, said channel having a liquid-receiving first end in communication with said inlet and a second end remote from said first end, the cross-sectional area of said channel decreasing in the direction of liquid flow from said first end toward said second end at a rate which is proportional to the distance from said first end, said channel further comprising an intermediate portion between said first and second ends and said unit further comprising a substantially funnel-shaped passage connecting said intermediate portion with said outlet.

11. The apparatus of claim 10, wherein said channel is configurated to circulate the liquid flowing from said inlet about said axis and the liquid continues to circulate in said passage and said outlet as well as upon entry into a container by way of said outlet.

12. The apparatus of claim 11, wherein said passage has a conical inlet portion in communication with the intermediate portion of said channel and a substantially annular lower portion surrounding said axis and communicating with said outlet.

13. The apparatus of claim 11, wherein said unit has a substantially cylindrical internal surface which surrounds said channel and has an axis coinciding with the axis of said outlet, said passage having a radially outermost portion at said surface.

14. The apparatus of claim 11, wherein said unit comprises at least one obstruction provided in said passage and arranged to slow down or terminate the circulation of liquid in said passage upon interruption of admission of liquid into said channel by way of said inlet.

15. The apparatus of claim 14, wherein said at least one obstruction includes at least one surface which directs liquid toward said axis.

16. The apparatus of claim 15, wherein said at least one surface extends substantially radially of said axis.

17. The apparatus of claim 14, wherein said unit has a surface adjacent said passage and said at least one obstruction is provided in said surface.

18. Apparatus for filling successive containers of a series of containers with a liquid, comprising a source of liquid; container filling means having at least one liquid discharging opening and defining a path for the flow of liquid from said source to said at least one opening; and a liquid conveying unit having an inlet in communication with said at least one opening, an outlet for admission of liquid into successive containers, and a liquid swirling channel which conveys liquid from said inlet toward said outlet and extends around said outlet, said outlet having a substantially vertical axis and said channel surrounding said axis, said channel having a liquid-receiving first end in communication with said inlet and a second end remote from said first end, the cross-sectional area of said channel decreasing in the direction of liquid flow from said first end toward said second end at a rate which is proportional to the distance from said first end, said filling means comprising a valve including a valving element movable between a first position in which said at least one opening is free to receive liquid from said source and a second position in which said valving element seals said opening and said inlet from said source.

19. Apparatus for filling successive containers of a series of containers with a liquid, comprising a source of liquid; container filling means having at least one liquid discharging opening and defining a path for the flow of liquid from said source to said at least one opening; and a liquid conveying unit having an inlet in communication with said at least one opening, an outlet for admission of liquid into successive containers, and a liquid swirling channel which conveys liquid from said inlet toward said outlet and extends around said outlet, said outlet having a substantially vertical axis and said channel surrounding said axis, said channel having a liquid receiving first end in communication with said inlet and a second end remote from said first end, the height of said channel in the direction of said axis decreasing from said first end toward said second end and the cross-sectional area of said channel decreasing in the direction of liquid from said first end toward said second end at a rate which is proportional to the distance from said first end.

20. Apparatus for filling successive containers of a series of containers with a liquid, comprising a source of liquid; container filling means having at least one liquid discharging opening and defining a path for the flow of liquid from said source to said at least one opening; and a liquid conveying unit having an inlet in communication with said at least one opening, an outlet for admission of liquid into successive containers, and a liquid swirling channel which conveys liquid from said inlet toward said outlet and extends around said inlet, said outlet having a substantially vertical axis and said channel surrounding sad axis, said channel having a liquid-receiving first end in communication with said inlet and a second end remote from and offset relative to said first end radially of said axis, said channel defining a helical path for the flow of liquid from said inlet to said outlet and the height of said channel in the direction of said axis decreasing from said first end toward said second end, the cross-sectional area of the channel decreasing in the direction of liquid flow from said first toward said second end at a rate which is proportional to the distance from said first end.

* * * * *